US012631084B2

(12) United States Patent
Fry et al.

(10) Patent No.: US 12,631,084 B2
(45) Date of Patent: May 19, 2026

(54) HIGH EXPANSION AGGREGATE SEAL

(71) Applicant: Schlumberger Technology Corporation, Sugar Land, TX (US)

(72) Inventors: Oliver Fry, Aberdeen (GB); Ilja Kivko, Aberdeen (GB); Alexander Rainy Brown, Aberdeen (GB); Robin Jonathan McGowan, Dubai (AE); Gareth Edward George Brown, Aberdeen (GB); Alexander Trushin, Perth (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/214,075

(22) Filed: May 21, 2025

(65) Prior Publication Data

US 2025/0376908 A1 Dec. 11, 2025

(30) Foreign Application Priority Data

Jun. 6, 2024 (GB) ..... 2408058

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)

(58) Field of Classification Search
CPC ..... E21B 33/1208; E21B 33/1277; E21B 33/128; E21B 33/1522; E21B 33/124
See application file for complete search history.

(56) References Cited

U.S. PATENT DOCUMENTS

| | | | | |
|---|---|---|---|---|
| 5,676,384 | A | 10/1997 | Culpepper | |
| 6,318,461 | B1 * | 11/2001 | Carisella | E21B 33/128 166/135 |
| 7,938,192 | B2 * | 5/2011 | Rytlewski | E21B 33/128 166/387 |
| 9,637,986 | B2 | 5/2017 | Frisby et al. | |
| 9,725,976 | B2 | 8/2017 | Loginov et al. | |
| 10,294,749 | B2 | 5/2019 | Rochen | |
| 10,808,493 | B2 | 10/2020 | Du et al. | |
| 11,834,924 | B2 | 12/2023 | Brown et al. | |
| 2012/0090830 | A1 * | 4/2012 | O'Malley | B22D 25/005 164/79 |
| 2015/0034316 | A1 * | 2/2015 | Hallundb | E21B 33/1285 166/180 |
| 2021/0230965 | A1 | 7/2021 | Zhong et al. | |
| 2022/0325600 | A1 | 10/2022 | Fripp et al. | |
| 2022/0381107 | A1 * | 12/2022 | Greci | E21B 33/1212 |

* cited by examiner

*Primary Examiner* — Kristyn A Hall
(74) *Attorney, Agent, or Firm* — Jeffrey D. Frantz

(57) ABSTRACT

A plugging tool, comprises a tool mandrel adapted to traverse an interior of a wellbore or well tubular. The mandrel has a seal section thereon, the seal section comprising longitudinally spaced apart extrusion barriers. The seal section comprises a mechanism to urge the extrusion barriers toward each other. At least one elastomer sealing element is disposed between the extrusion barriers and arranged to radially expand when the extrusion barriers are urged toward each other.

16 Claims, 4 Drawing Sheets

HIGH EXPANSION AGGREGATE SEAL

CROSS-REFERENCE TO RELATED APPLICATION

The present disclosure claims priority from United Kingdom Patent Application No. 2408058.2, filed Jun. 6, 2024.

BACKGROUND

This disclosure relates to the field of plugs used to hydraulically close subsurface wells by being set within a wellbore or a tubular (e.g., casing, liner or tubing) disposed within a wellbore. More particularly, the disclosure relates to structures for elastomer seals that are radially expanded to hydraulically close the well by radial expansion to contact the interior of the wellbore or well tubular.

Plugs known in the art for hydraulic closure of wells include radially expandable elastomer sealing elements that are expanded to form a pressure tight seal inside a wellbore or well tubular. The elastomer is deformed as a result of radial expansion, and this makes it necessary to use elastomer with mechanical properties enabling such expansion. The deformation requires a substantial amount of mechanical work to effect the expansion, and correspondingly limits the types and/or compositions of elastomers that may be used for such plugs. An example of a well plug using radially expandable elastomer sealing elements is described in U.S. Pat. No. 10,808,493 issued to Du et al.

It is desirable to have a plug capable of large radial expansion with reduced mechanical work to effect the expansion, and being able to use a wider range of elastomeric materials than using radial expansion plugs known in the art.

SUMMARY

One aspect of the present disclosure is a plugging tool. A plugging tool according to this aspect comprises a tool mandrel adapted to traverse an interior of a wellbore or well tubular. The mandrel has a seal section thereon, the seal section comprising longitudinally spaced apart extrusion barriers. The seal section comprises a mechanism to urge the extrusion barriers toward each other. At least one elastomer sealing element is disposed between the extrusion barriers and arranged to radially expand when the extrusion barriers are urged toward each other.

In some implementations, at least one elastomer sealing element comprises an elastomer cord wound around the tool mandrel between the extrusion barriers.

In some implementations, at least one elastomer sealing element comprises a plurality of elastomer cords extending longitudinally between the extrusion barriers.

In some implementations, at least one elastomer sealing element comprises discrete bodies of elastomer.

In some implementations, the discrete bodies comprise at least one of spheres, shreds or cord segments.

In some implementations, the spheres comprise a metal core surrounded by elastomer.

In some implementations, the discrete bodies are disposed in a volume fill material.

In some implementations, the volume fill material comprises at least one or more of potting material, liquid or sand and clay mixture.

In some implementations, the discrete bodies are a same size.

In some implementations, the discrete bodies comprise different sizes.

In some implementations, the extrusion barriers are radially expandable.

Some implementations comprise a retaining sleeve disposed over the discrete bodies.

A method for plugging a wellbore or well tubular according to another aspect of this disclosure includes moving a plugging tool to a selected position within the wellbore or well tubular. The plugging tool comprises a tool mandrel adapted to traverse an interior of a wellbore or well tubular having a seal section thereon. The seal section comprises longitudinally spaced apart extrusion barriers. The seal section comprises a mechanism to urge the extrusion barriers toward each other, and at least one elastomer sealing element disposed between the extrusion barriers and arranged to radially expand when the extrusion barriers are urged toward each other. The method comprises moving at least one or both extrusion barriers toward the other extrusion barrier to longitudinally compress and radially expand the at least one elastomer sealing element.

In some implementations, at least one elastomer sealing element comprises an elastomer cord wound around the tool mandrel between the extrusion barriers.

In some implementations, at least one elastomer sealing element comprises a plurality of elastomer cords extending longitudinally between the extrusion barriers.

In some implementations, at least one elastomer sealing element comprises discrete bodies of elastomer.

In some implementations, the discrete bodies comprise at least one of spheres, shreds or cord segments.

In some implementations, the spheres comprise a metal core surrounded by elastomer.

In some implementations, the discrete bodies are disposed in a volume fill material.

In some implementations, the volume fill material comprises at least one or more of potting material, liquid or sand and clay mixture.

In some implementations, the discrete bodies are a same size.

Some implementations further comprise a retaining sleeve disposed over the discrete bodies.

Some implementations further comprise radially expanding the extrusion barriers after the plugging tool is moved to the selected position so as to substantially fill a cross section of the wellbore or well tubular.

Other aspects and possible advantages will be apparent from the description and claims that follow.

DETAILED DESCRIPTION

Figure 1:
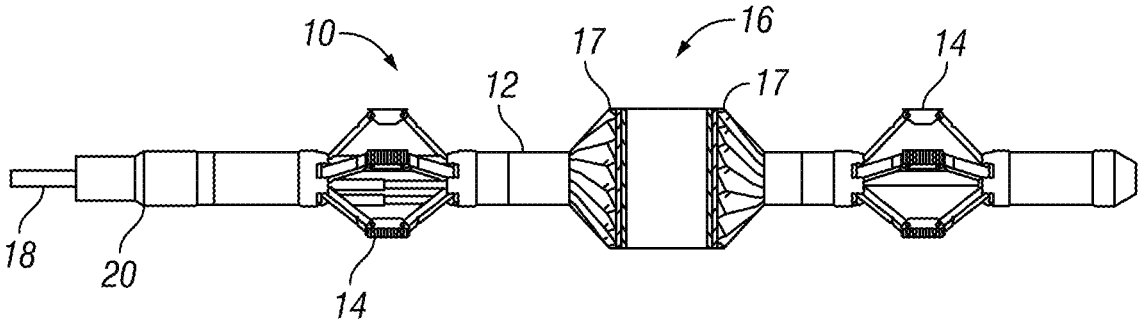
FIG. 1 shows an example plugging tool according to the present disclosure.

An example implementation of a plugging tool is shown schematically in FIG. 1 at 10. The plugging tool 10 may comprise a tool mandrel 18 disposed within and along the length of a tool chassis 12, onto which components of an expandable plug may be mounted. The tool chassis 12 may be generally cylindrically shaped and have disposed at selected location(s) along its length one or more slips 14 that will radially expand to set the plugging tool 10 at a selected position within a wellbore or well tubular (e.g., casing, liner or tubing), during movement of the plugging tool 10 along the wellbore or well tubular. The mandrel 18 may be releasably connected to a conveyance (not shown), for example and without limitation, armored electrical cable (wireline), slickline, coiled tubing, jointed tubing, sucker rods or a well tractor; the conveyance (not shown) may be used to convey the plugging tool 10 to the selected location within the wellbore or well tubular. The conveyance (not shown) will typically connect to the mandrel 18 in tension, and to the chassis 12 in compression, e.g., at a connection point 20.

A seal section 16 may be disposed on or along the mandrel 18 at a selected longitudinal position, in the present example implementation between spaced apart slips 14 such as shown in FIG. 1. In general, the seal section 16 comprises one or more elastomer sealing elements, explained in more detail below, that may be longitudinally compressed and consequently radially expanded to hydraulically close or seal an annular space (not shown) between the mandrel 18 and the interior wall (not shown) of the wellbore or well tubular. The seal section 16 will be further explained below with reference to various example implementations.

In various example implementations, extrusion barriers 17 in the seal section 16 may be longitudinally spaced apart and either or both extrusion barriers 17 may be made to move longitudinally in the direction of the other extrusion barrier 17 to reduce the longitudinal distance between them, thereby compressing seal element(s) to be explained in more detail below. In some example implementations, the extrusion barriers 17 may be in radially retracted form, that is, they may traverse a relatively small external diameter, prior to moving the one or both extrusion barriers 17 toward the other to compress the seal element(s). The extrusion barriers 17 may then be radially expanded to fill substantially all the cross section of the wellbore or well tubular during longitudinal compression in order to retain the seal element(s). Such radial expansion capability may provide that the plugging tool 10 more readily traverses the wellbore or well. A non-limiting example implementation of such extrusion barriers and a device to cause longitudinal compression of the extrusion barriers is described in U.S. Pat. No. 11,834,924 issued to Brown et al.

Figure 2:
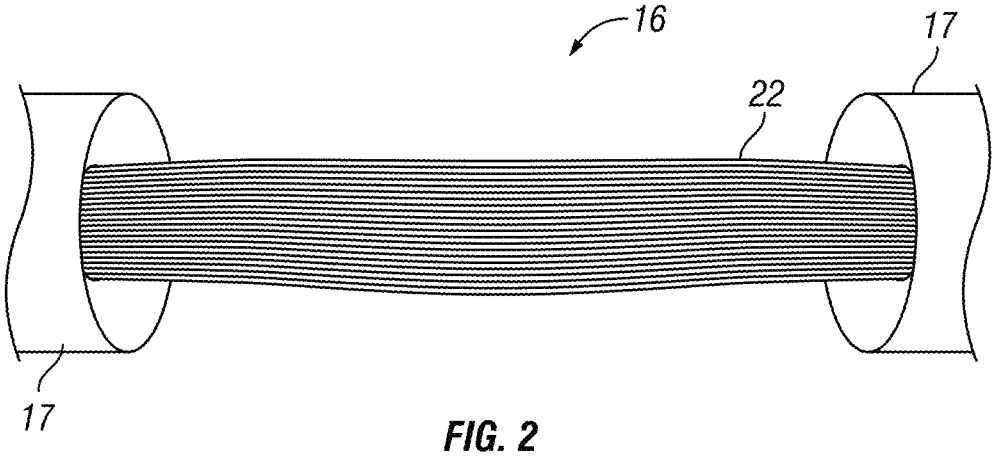
FIG. 2 shows an example implementation of a seal section for the plugging tool shown in FIG. 1.

An example implementation of the seal section 16 is shown in FIG. 2. The seal section 16 may comprise laterally spaced apart extrusion barriers 17 disposed along the mandrel (18 in FIG. 1, not shown in FIG. 2). The extrusion barriers 17 may have an external diameter chosen to enable free movement of the plugging tool (10 in FIG. 1) along the wellbore or well tubular, yet resist extrusion of one or more discrete elastomer sealing elements when the sealing elements are longitudinally compressed. At least one of the extrusion barriers 17 is arranged to be moved longitudinally along the mandrel (18 in FIG. 1) in the direction of the other extrusion barrier 17. A plurality of discrete sealing elements, which in the present example are elastomer cords 22 may be disposed between the extrusion barriers 17 on the exterior of the mandrel (18 in FIG. 1) and attached at each of their longitudinal ends to one of the extrusion barriers 17 or to the mandrel (18 in FIG. 1). Properties of the elastomer cords 22 will be explained in more detail below. In the present example implementation, the elastomer cords 22 may be solid or fully filled cross-section. When the elastomer cords 22 are longitudinally compressed by movement of at least one of the extrusion barriers 17, the elastomer cords 22 form a tangle or become intertwined such that the diameters defined by the tangle or intertwined cords radially fills an annular space (not shown) between the mandrel (18 in FIG. 1) and the wellbore or well tubular (not shown) longitudinally disposed between the extrusion barriers 17. The diameter and length of the elastomer cords 22 may be chosen based on, for example, the inner diameter of the wellbore (not shown) or well tubular (not shown), the outer diameter of the mandrel (18 in FIG. 1) and the maximum longitudinal spacing between the extrusion barriers 17. It will be appreciated that a shorter maximum longitudinal spacing may facilitate movement of the plugging tool (10 in FIG. 1) through a wellbore or well tubular section having a relatively small bend radius (high "dog leg severity") as may be the case in directionally drilled wells.

Figure 3:
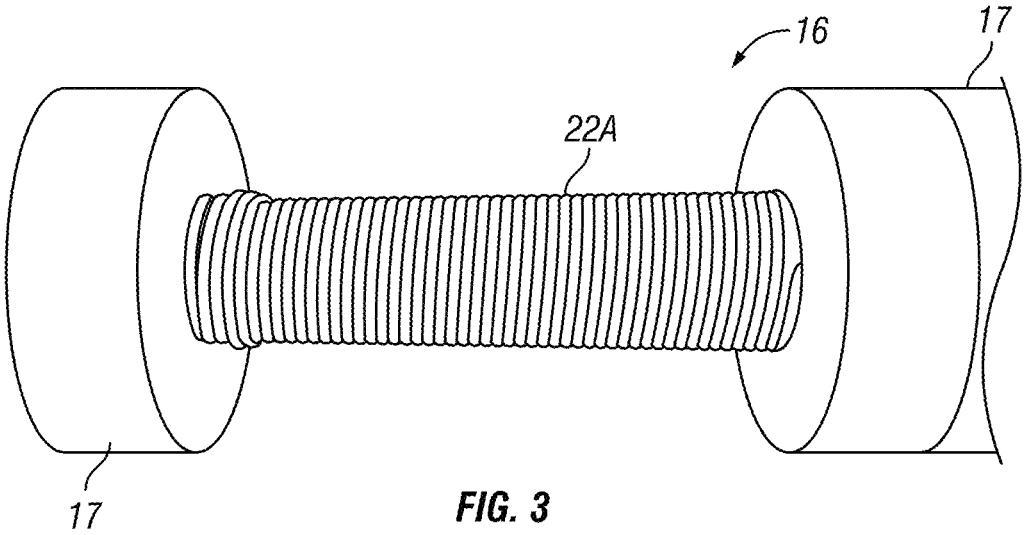
FIG. 3 shows an example implementation of a seal section for the plugging tool shown in FIG. 1.

FIG. 3 shows another example implementation of the seal section 16. In the present example implementation, the sealing element(s) may comprise a single elastomer cord 22A that is wound around the mandrel 18 between the extrusion barriers 17. The elastomer cord 22A may be coupled at each longitudinal end, for example, to the mandrel (18 in FIG. 1). When the extrusion barriers 17 are moved toward each other, the elastomer cord 22A intertwines so as to define an increasing outer diameter and ultimately able to seal the annular space (not shown) in a manner similar to the example implementation shown in FIG. 2. In the example implementations shown in FIGS. 2 and 3, no bonding occurs between surfaces of the one or more elastomer cords (22 in FIG. 2), 22A and any other object, including the mandrel 18, the extrusion barriers 17 and the inner wall of the wellbore or well tubular. Sealing is obtained only by compression of surfaces of the parts of the one or more elastomer cords (22 in FIG. 2), 22A that come into contact with any of the foregoing and into contact with the mandrel 18, and the extrusion barriers 17.

Figure 4A:
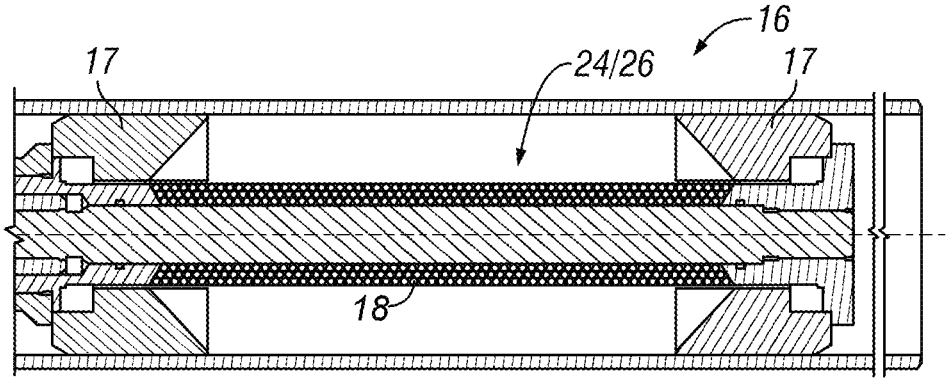
FIG. 4A shows an example implementation of a seal section for the plugging tool shown in FIG. 1.
Figure 4B:
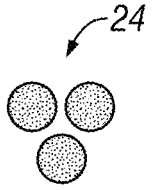
FIG. 4B shows an example implementation of discrete sealing elements for the example implementation of a seal section shown in FIG. 4A.

FIG. 4A shows another example implementation of the seal section 16. In the present example implementation, a plurality of discrete sealing bodies or sealing elements 24 may be disposed on the exterior of the mandrel 18 between the extrusion barriers 17. The discrete sealing elements 24 may be covered on their exterior by a retaining sleeve 26, which may be made from elastomer. Material properties of the retaining sleeve 26 may be chosen such that the retaining sleeve 26 only provides the function of retaining the discrete sealing elements 24 in position on the exterior surface of the mandrel 18. The retaining sleeve 26 need not perform any sealing function when the seal section 16 is radially expanded, and may be enabled to rupture when the seal section 16 is longitudinally compressed, such that all sealing is provided by the discrete sealing elements 24. In the present example implementation, and referring to FIG. 4B, the discrete sealing elements 24 may comprise elastomer spheres.

Figure 4C:
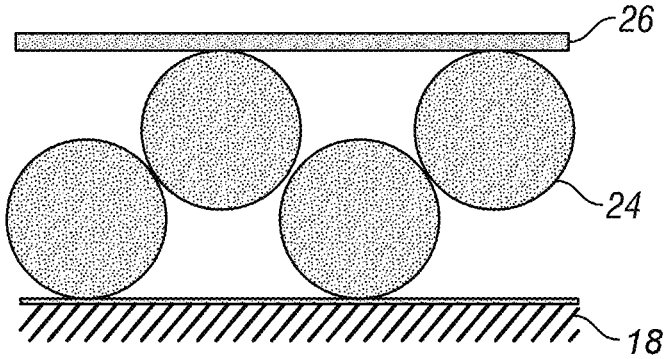
FIG. 4C shows part of the seal section of FIG. 4A in more detail to illustrate arrangement of the discrete sealing elements and packaging sleeve.

In FIG. 4C, a general arrangement of the discrete sealing elements 24, mandrel 18 and elastomer sleeve 26 is shown to illustrate the sealing principle of the present example of the seal section (16 in FIG. 4A). When the extrusion barriers (17 in FIG. 4A) are moved to longitudinally compress the discrete sealing elements 24, the arrangement of the discrete sealing element 24 changes such that the annular space, as defined above, is sealed by the changed geometric arrangement of the discrete sealing elements 24. No surface bonding between any of the discrete sealing elements 24, the mandrel 18, the extrusion barriers (17 in FIG. 4A) takes place; sealing is effected only by surface contact between the foregoing and the discrete sealing elements 24, and surface compression of the discrete sealing elements 24.

Figure 4D:
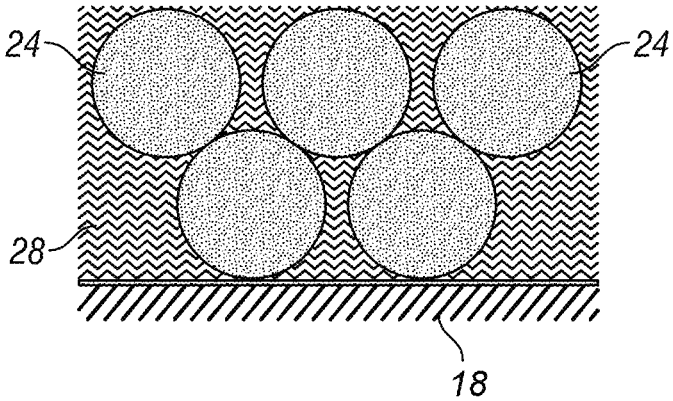
FIGS. 4D and 4E show other example implementations of the part of the seal section of FIG. 4C.

FIG. 4D shows another example implementation of the seal section (16 in FIG. 4A) in which the discrete sealing elements 24 are disposed on the exterior of the mandrel 18. The discrete sealing elements 24 may be elastomer spheres as in other implementations, and may be embedded in a low-durometer, low-stiffness, low strength potting compound 28. The potting compound 28 in this implementation is used only to retain the discrete sealing elements 26 in place on the exterior of the mandrel during deployment of the sealing tool (10 in FIG. 1), and to fill the volume not occupied by the discrete sealing elements 24 in the space between the elastomer sleeve 26 and the mandrel 18. Such retention may comprise a geometric arrangement of the discrete sealing elements 24 to facilitate radial expansion and volume fill when the extrusion barriers (17 in FIG. 4A) are moved to compress the discrete sealing elements 24. Properties of the potting compound 28 may be chosen accordingly.

Figure 4E:
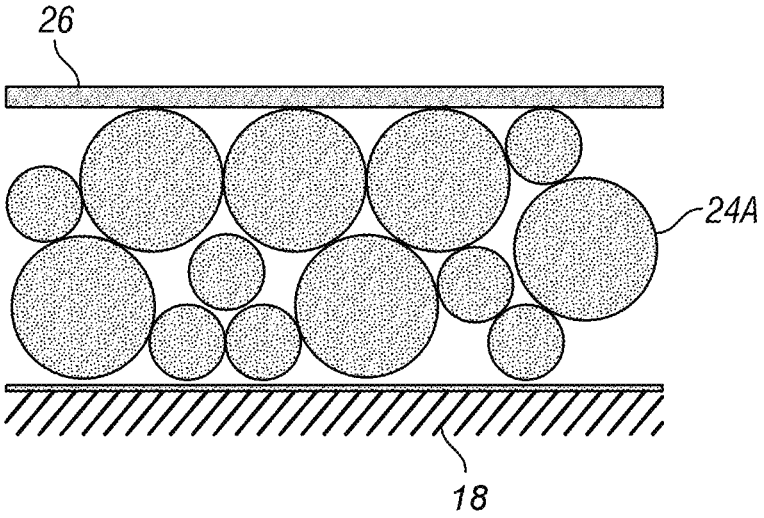

FIG. 4E shows another example implementation of the seal section (16 in FIG. 4A) in which the discrete sealing elements 24A comprise elastomer spheres of a plurality of diameters disposed on the exterior of the mandrel 18. The discrete sealing elements 24A may be covered on their exterior by an elastomer sleeve 26 as with the example implementation shown in FIG. 4A and FIG. 4C. It is to be understood that the present example implementation of the discrete sealing elements 24A may also be used with potting compound as shown at 28 in FIG. 4D.

Figure 5:
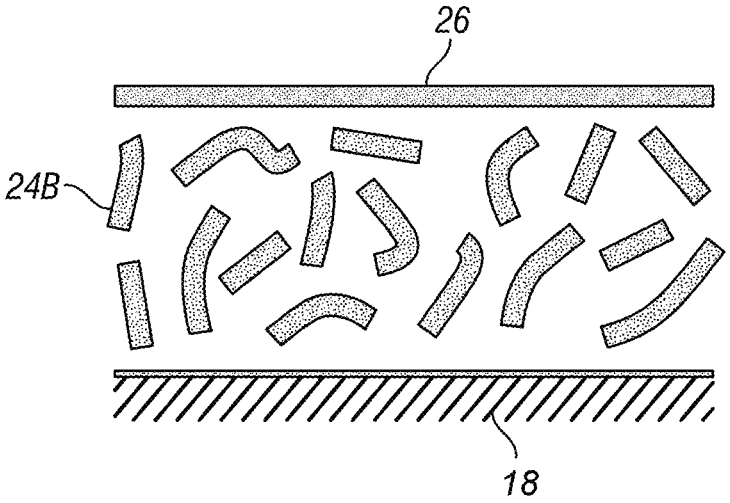
FIGS. 5 and 6 show other example implementations of the part of the seal section shown in FIG. 4A.

FIG. 5 shows another example implementation of the seal section (16 in FIG. 1) which may be arranged in general as the example shown in and explained with reference to FIG. 4A. In the present example implementation, the discrete sealing elements 24B may be in the form of short elastomer cords, elastomer shreds or otherwise shaped pieces of elastomer that may be longitudinally compressed and thereby form a structure (not shown) that seals the annular space as previously defined. The discrete sealing elements 24B may be disposed on the exterior of the mandrel 18 and retained by an elastomer sleeve 26 as explained with reference to FIG. 4A. As in other example implementations, no bonding takes place between the surface of the discrete sealing elements 24B and any other object.

Figure 6:
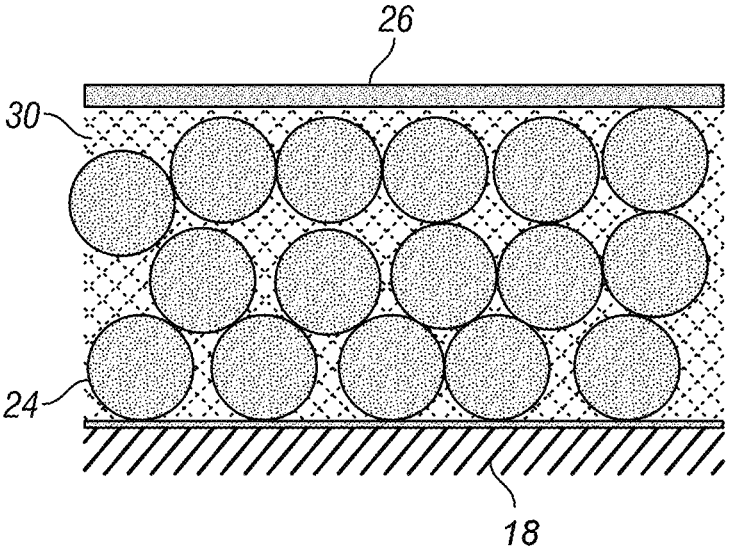

An example implementation shown in FIG. 6 includes a plurality of discrete sealing elements 24, which may be elastomer spheres disposed on the mandrel 18 as explained with reference to FIGS. 4A and 4C. As with the examples explained with reference to FIGS. 4A and 4C, the discrete sealing elements 24 may be covered on their exterior by an elastomer sleeve 26. A filler material 30 may be disposed in the interstitial spaces between the discrete sealing elements 24. The filler material 30 may be, for example and without limitation, mixtures of sand and clay, which may include in some instances bentonite or similar clay minerals. The filler material 30 may retain the discrete sealing elements 24 in their respective positions during deployment of the plugging tool (10 in FIG. 1) in a wellbore or well tubular.

Figure 7:
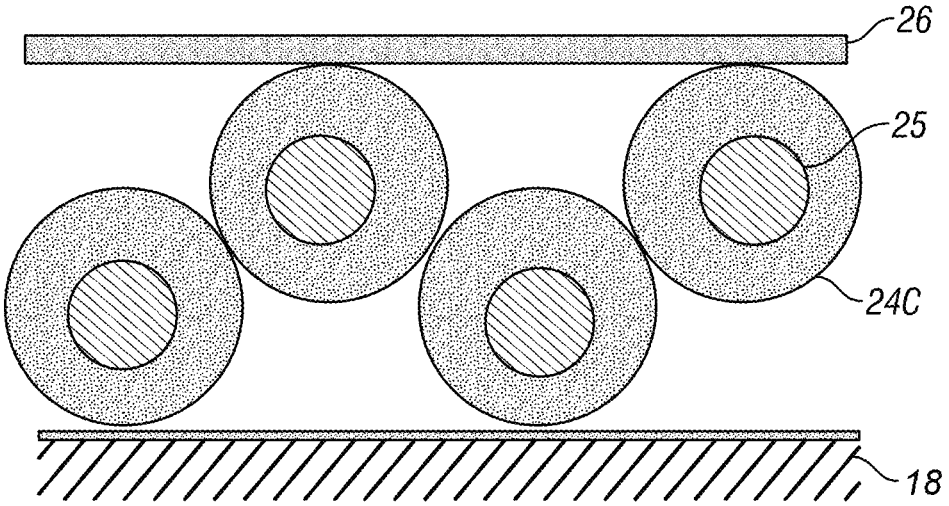
FIG. 7 shows an example implementation of the discrete sealing elements that may be used in various examples of the seal section.

An example implementation shown in FIG. 7 may be arranged in general as the example shown in FIG. 4A. The present example implementation includes a plurality of discrete sealing elements 24C, which may be generally spherically shaped as in the examples of FIGS. 4A through 4E. In the present example implementation, one or more of the discrete sealing elements 24C may comprise a metal core 25, e.g., made from steel, covered by an elastomer sleeve 26.

A seal section and a plugging tool having such seal section according to the present disclosure may reduce or even eliminate the mechanical work required when setting the seal element in a well, that is, the amount of work needed during the transition from the run-in-well/initial shape/volume of the seal section (longitudinally expanded and radially contracted) and the set shape/volume of the seal section (longitudinally compressed and radially expanded).

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A plugging tool, comprising:

a tool mandrel adapted to traverse an interior of a wellbore or well tubular; and a seal section supported on the tool mandrel, the seal section comprising:

a pair of extrusion barriers spaced apart from one another along a longitudinal direction of the tool mandrel;

a mechanism to urge the extrusion barriers toward each other; and a sealing element disposed between the extrusion barriers, the sealing element comprising a plurality of discrete bodies, the plurality of discrete bodies comprising elastomer spheres, the plurality of discrete bodies positioned in a first geometric arrangement while the sealing element is subjected to a first compressive load in the longitudinal direction, the plurality of discrete bodies positioned in a second geometric arrangement while the sealing element is subjected to a second compressive load in the longitudinal direction, the second compressive load being greater than the first compressive load, at least some of the discrete bodies being displaced relative to one another in a radial direction in response to the extrusion barriers being urged toward each other.

2. The plugging tool of claim 1, wherein the elastomer spheres comprise a metal core surrounded by elastomer.

3. The plugging tool of claim 1, wherein the plurality of discrete bodies is disposed in a volume fill material.

4. The plugging tool of claim 3, wherein the volume fill material comprises at least one or more of potting material, liquid or sand and clay mixture.

5. The plugging tool of claim 1, wherein the plurality of discrete bodies is a same size.

6. The plugging tool of claim 1, wherein the plurality of discrete bodies comprises different sizes.

7. The plugging tool of claim 1, further comprising a retaining sleeve disposed over the plurality of discrete bodies.

8. The plugging tool of claim 1, wherein the extrusion barriers are radially expandable.

9. The plugging tool of claim 1, wherein an individual size and shape of each of the plurality of discrete bodies remains substantially unchanged when the extrusion barriers are urged toward each other.

10. The plugging tool of claim 1, wherein the sealing element further comprises a retaining sleeve disposed over the plurality of discrete bodies and a potting compound surrounding the plurality of discrete bodies between the retaining sleeve and the tool mandrel, the potting compound retaining the plurality of discrete bodies in the first geometric arrangement prior to the extrusion barriers being urged toward each other.

11. The plugging tool of claim 1, wherein the plurality of discrete bodies is disposed in interstitial spaces between one another in a filler material comprising a mixture of sand and clay, the filler material retaining the plurality of discrete bodies in the first geometric arrangement prior to the extrusion barriers being urged toward each other.

12. A method for plugging a wellbore or well tubular, comprising:

moving a plugging tool to a selected position within the wellbore or well tubular, the plugging tool comprising a tool mandrel adapted to traverse an interior of the wellbore or well tubular and a seal section supported on the tool mandrel, the seal section comprising:

a pair of extrusion barriers spaced apart from one another along a longitudinal direction of the tool mandrel;

a mechanism to urge the extrusion barriers toward each other; and a sealing element disposed between the extrusion barriers, the sealing element comprising a plurality of discrete bodies, the plurality of discrete bodies comprising elastomer spheres, a geometric arrangement of the plurality of discrete bodies forming a volume disposed between the extrusion barriers; and moving one of the extrusion barriers toward the other of the extrusion barriers to longitudinally compress and radially expand the volume formed by the geometric arrangement of the plurality of discrete bodies, such that at least some of the plurality of discrete bodies are displaced relative to one another in a radial direction to change the geometric arrangement of the plurality of discrete bodies.

13. The method of claim 12, further comprising radially expanding the extrusion barriers after the plugging tool is moved to the selected position so as to substantially fill a cross section of the wellbore or well tubular.

14. The method of claim 12, wherein the elastomer spheres comprise a metal core surrounded by elastomer.

15. The method of claim 12, wherein the elastomer spheres have a plurality of different diameters, and wherein the sealing element further comprises a retaining sleeve disposed over the plurality of discrete bodies.

16. The method of claim 12, wherein the plurality of discrete bodies are covered by a retaining sleeve comprising elastomer, and wherein moving one of the extrusion barriers toward the other of the extrusion barriers longitudinally compresses the plurality of discrete bodies such that the retaining sleeve ruptures and the plurality of discrete bodies are displaced radially outward to fill an annular space between the tool mandrel and an interior wall of the wellbore or well tubular, with sealing effected solely by the plurality of discrete bodies and without any surface bonding between any of the discrete bodies.

* * * * *